US010413044B2

(12) United States Patent
Husband

(10) Patent No.: US 10,413,044 B2
(45) Date of Patent: Sep. 17, 2019

(54) QUICK-RELEASE ATTACHMENT MECHANISM AND A PORTABLE CONTAINER WITH A QUICK-RELEASE ATTACHMENT MECHANISM

(71) Applicant: Casey Husband, Windsor, VT (US)

(72) Inventor: Casey Husband, Windsor, VT (US)

( * ) Notice: Subject to any disclaimer, the term of this patent is extended or adjusted under 35 U.S.C. 154(b) by 87 days.

(21) Appl. No.: 15/464,445

(22) Filed: Mar. 21, 2017

(65) Prior Publication Data

US 2017/0273442 A1 Sep. 28, 2017

Related U.S. Application Data

(60) Provisional application No. 62/311,723, filed on Mar. 22, 2016.

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01)

(58) Field of Classification Search
CPC ..... A45F 3/04; A45F 2003/001
USPC ..... 224/191
See application file for complete search history.

(56) References Cited

U.S. PATENT DOCUMENTS 4,858,797 A * 8/1989 Rabska ..... A62C 33/00 224/162
5,014,359 A 5/1991 Hanson
D332,171 S 1/1993 Gudas
5,205,672 A * 4/1993 Stinton ..... B63C 11/30 405/186
5,311,833 A * 5/1994 VanTassel ..... B63C 11/30 114/315
5,341,973 A * 8/1994 Dawes ..... A45F 3/04 221/185
5,724,707 A * 3/1998 Kirk ..... A41D 13/0012 2/102
5,921,388 A * 7/1999 Petrilli ..... A62C 2/06 206/315.1
5,934,533 A * 8/1999 Callanan ..... A45F 3/04 224/250
6,516,981 B2 2/2003 Perez
7,047,570 B2 * 5/2006 Johnson ..... F41H 1/02 2/102
7,080,430 B2 7/2006 Wemmer
7,240,404 B2 * 7/2007 Flossner ..... A41D 13/0012 2/101
7,490,358 B1 * 2/2009 Beck ..... A41D 13/0531 2/102
7,526,842 B2 * 5/2009 Wemmer ..... A41D 27/20 24/3.7

(Continued)

OTHER PUBLICATIONS

Coxworth, wolffepack lets you access your backpack—without taking it off, available at http://newatlas.com/wolffepack-backpack/34370/; accessed Mar. 1, 2017.

(Continued)

*Primary Examiner* — Nathan J Newhouse
*Assistant Examiner* — Lester L Vanterpool
(74) *Attorney, Agent, or Firm* — Caldwell Intellectual Property Law

(57) ABSTRACT

A quick-release attachment mechanism includes a fastener that attaches an object to a user. The fastener is disengaged by pulling on a pull-handle.

17 Claims, 6 Drawing Sheets

(56) References Cited

U.S. PATENT DOCUMENTS

| | | | | |
|---|---|---|---|---|
| 7,694,862 | B2 * | 4/2010 | Bergeron | A45F 5/02 224/665 |
| 7,909,214 | B2 * | 3/2011 | Gold | A45F 3/02 224/236 |
| 8,079,503 | B1 * | 12/2011 | Yeates | A45C 7/0086 224/268 |
| 8,336,171 | B2 * | 12/2012 | Colorado | A45F 3/10 224/675 |
| 8,453,899 | B1 * | 6/2013 | Calkin | A45F 5/02 224/675 |
| 8,584,917 | B2 * | 11/2013 | Hexels | A45F 3/08 2/102 |
| 8,720,762 | B2 * | 5/2014 | Hilliard | F42B 39/02 224/675 |
| 8,814,020 | B2 * | 8/2014 | Yaeger | A45F 3/06 224/627 |
| 8,844,062 | B2 | 9/2014 | Tirard | |
| 8,997,262 | B2 | 4/2015 | Klein | |
| 9,074,840 | B2 * | 7/2015 | Andersen | A45F 3/06 |
| 9,144,294 | B2 * | 9/2015 | Gregory | A41D 13/0012 |
| 9,241,515 | B2 | 1/2016 | Kim | |
| 9,554,638 | B2 | 1/2017 | Redli | |
| 9,874,423 | B1 * | 1/2018 | Hughes | A41D 13/0012 |
| 9,949,514 | B2 * | 4/2018 | Gill | F41H 1/02 |
| 2006/0163304 | A1 * | 7/2006 | Slesar | A45F 5/02 224/601 |
| 2006/0213944 | A1 | 9/2006 | Dieter | |
| 2008/0257922 | A1 * | 10/2008 | Cragg | A45F 5/02 224/269 |
| 2009/0173763 | A1 * | 7/2009 | Bridgeman | A45F 3/047 224/674 |
| 2010/0025560 | A1 * | 2/2010 | Beck | A45F 5/02 248/558 |
| 2010/0282803 | A1 | 11/2010 | Simmons | |
| 2011/0233242 | A1 | 9/2011 | Broudy | |
| 2011/0278339 | A1 * | 11/2011 | Hexels | A45F 3/08 224/676 |
| 2016/0033235 | A1 | 2/2016 | Kinnings | |
| 2016/0360864 | A1 | 12/2016 | Drake | |
| 2016/0360870 | A1 | 12/2016 | Langenwalter | |

OTHER PUBLICATIONS

Tactical Tailor Removable Operator Pack, available at http://www.skdtac.com/Tactical-Tailor-Removable-Operator-Pack-p/ttr.128.htm; accessed Feb. 28, 2017.

Verseidag Plate Carrier, NIJ IIIA, available at https://varuste.net/en/Verseidag+Plate+Carrier%2C+NIJ+IIIA?_tu=55859; accessed Feb. 28, 2017.

* cited by examiner

QUICK-RELEASE ATTACHMENT MECHANISM AND A PORTABLE CONTAINER WITH A QUICK-RELEASE ATTACHMENT MECHANISM

CROSS-REFERENCE TO RELATED APPLICATION

This application claims benefit of priority to U.S. provisional patent application No. 62/311,723, filed Mar. 22, 2016, the entirety of which is incorporated herein by reference.

FIELD OF THE INVENTION

The present invention generally relates to the field of personal accessories. In particular, the present invention is directed to methods and systems for providing a quick-release attachment mechanism.

BACKGROUND

Backpacks represent a ubiquitous, convenient way to carry useful items on the person of a user. However, the majority of the contents in a backpack cannot typically be accessed while the backpack is on the user's back. Reaching contents in a backpack either requires the complete removal of the backpack or detachment of the backpack from the equipment it is mounted to. If traditional backpacks are layered on top of protective vests or other equipment, the user must layer the backpack straps on top of the protective vest. If the backpack can be attached to the protective vest or other equipment the operator is still unable to reach all of its contents without taking the backpack off completely, due to the fact that it is located in the center of the user's back, where the user cannot readily reach and manipulate the backpack or its contents. In high-stress situations, such as combat or medical emergency, removing a backpack to access its contents is inconvenient and dangerous, unacceptably limiting the user's mobility and wasting time.

SUMMARY OF THE DISCLOSURE

In one embodiment, a quick-release attachment mechanism is disclosed. Quick-release attachment mechanism includes a press-fastener having a first surface secured to a user, the press-fastener attaching an object to the user. Quick-release attachment mechanism includes a pull handle attached to press-fastener, the pull handle acting to disengage the press-fastener when pulled by the user.

In another embodiment, a portable container with a quick-release attachment mechanism is disclosed. Portable container includes at least a compartment. Portable container includes a press-fastener secured to a user, the press-fastener attaching at least a compartment to the user. Portable container includes a pull handle attached to at least a compartment, the pull handle acting to disengage the press-fastener when pulled by the user.

In another embodiment, a quick-release attachment mechanism is disclosed. Quick-release attachment mechanism includes a first fastener secured to a user, the first fastener attaching an object to the user. Quick-release attachment mechanism includes a pull handle attached to first fastener, the pull handle acting to disengage the first fastener when pulled by the user. Quick-release attachment mechanism includes at least a flexible connector attaching object to user, the at least a first flexible connector including at least a second fastener linking the object to the user.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

During both normal and high-stress situations, embodiments of disclosed quick-release attachment mechanism allows the user to easily access the contents of a backpack, or to access any other item attached to the user by quick-release attachment mechanism, at an easier position than the middle of the back and using only one arm, if necessary. In some embodiments, the user can access the contents of the backpack without detaching the backpack from the back of the user. A second quick-release locking system enables complete detachment in some embodiments.

Figure 1A:
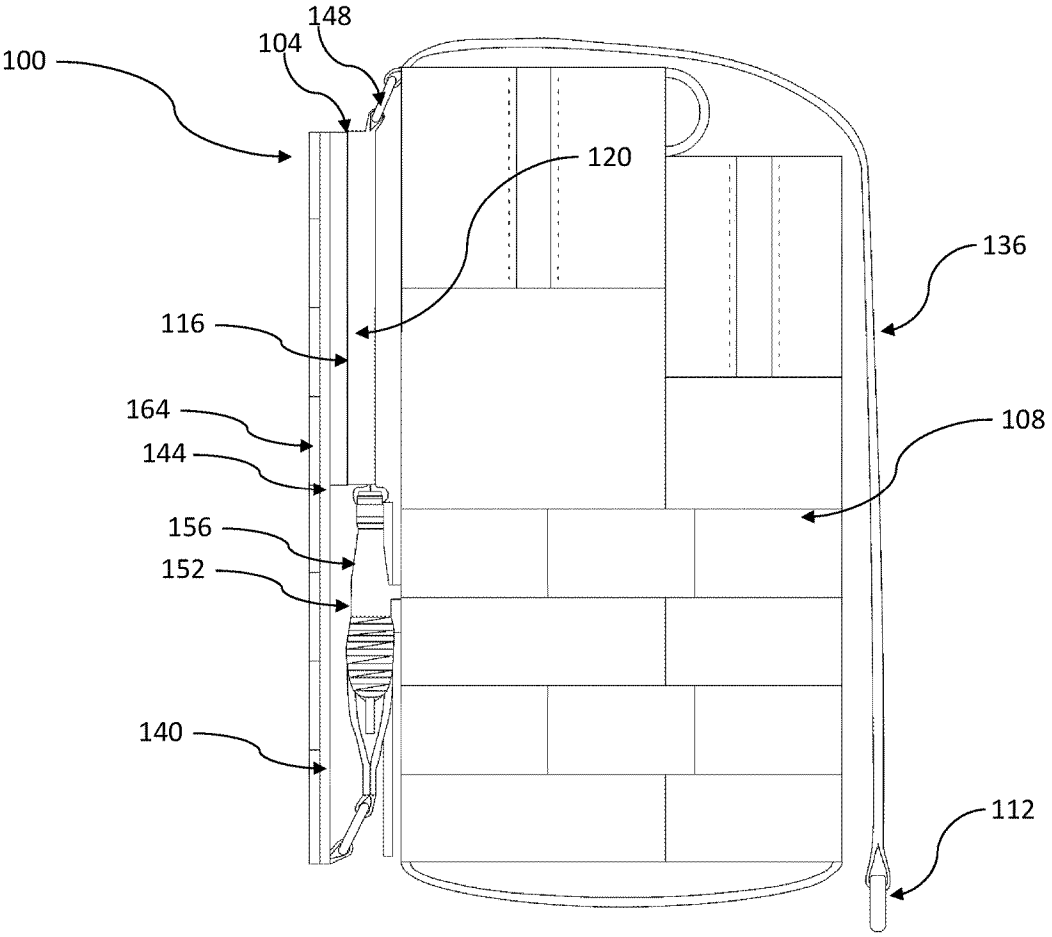
FIG. 1A is an illustration of an exemplary quick-release attachment mechanism in accordance with aspects of an embodiment.
Figure 1B:
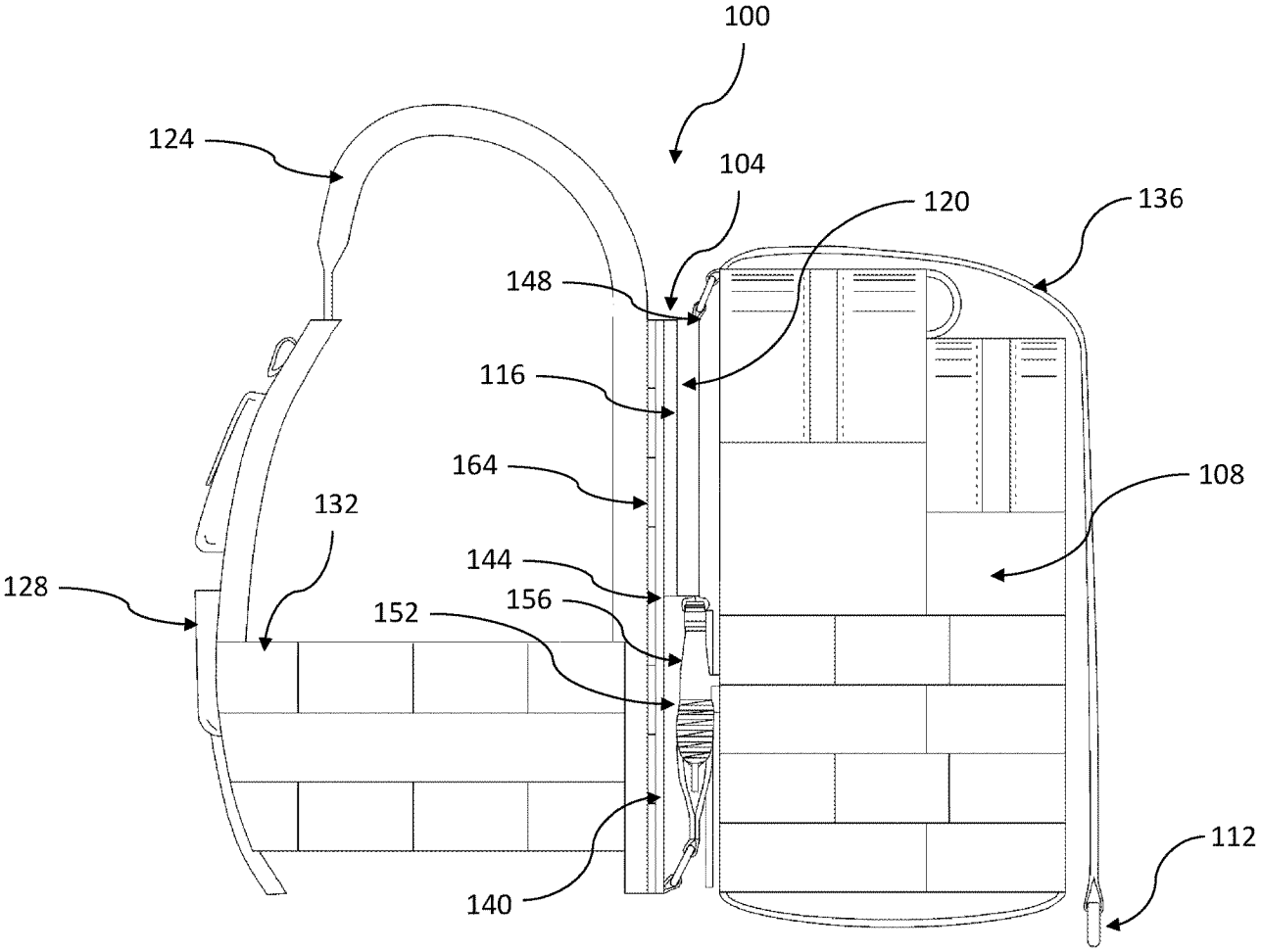
FIG. 1B is an illustration of an exemplary quick-release attachment mechanism in accordance with aspects of an embodiment.
Figure 1C:
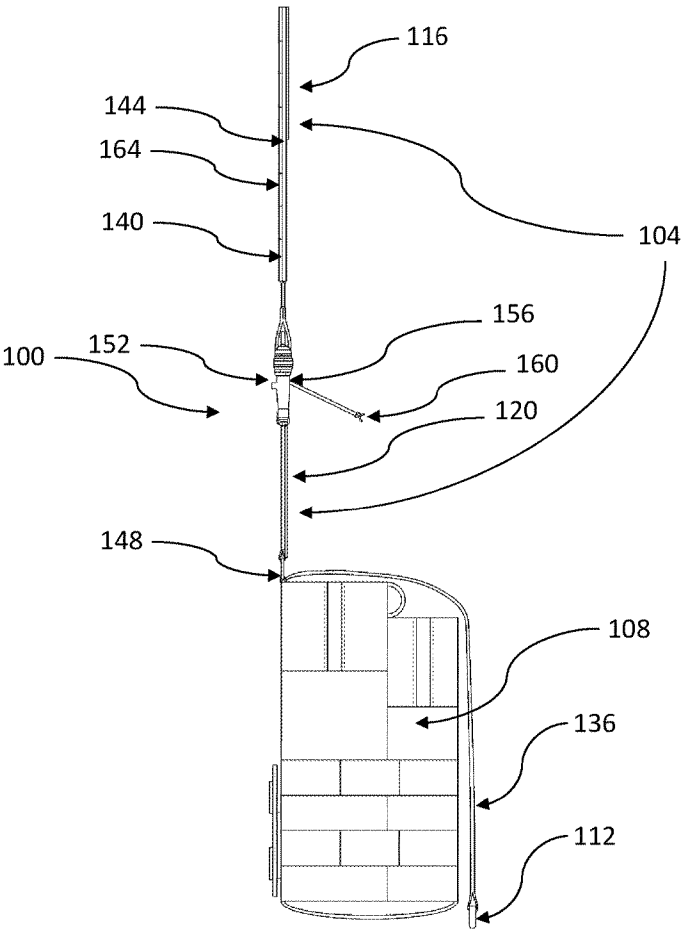
FIG. 1C is an illustration of an exemplary quick-release attachment mechanism in accordance with aspects of an embodiment.

Turning now to the drawings, FIGS. 1A and 1B illustrate an exemplary embodiment of a quick-release attachment mechanism 100. Quick-release attachment mechanism 100 includes a fastener 104 secured to a user. Fastener 104 attaches an object 108 to the user. Quick-release attachment mechanism 100 includes a pull-handle 112 attached to object 108. Pull-handle acts to disengage fastener 104 when pulled by the user. FIGS. 1A and 1B illustrate exemplary embodiments of quick-release attachment mechanism 100 with fastener 104 engaged, while FIG. 1C illustrates an exemplary embodiment of quick-release attachment mechanism 100 with fastener 104 disengaged.

Viewing FIGS. 1A-B in further detail, fastener 104 may be a press fastener. As used herein, a press fastener is a fastener that couples a first surface to a second surface when the two surfaces are pressed together. Some press fasteners include elements on the first surface that interlock with elements on the second surface; such fasteners include without limitation hook-and-loop fasteners such as VELCRO fasteners produced by Velcro Industries B.V. Limited Liability Company of Curacao Netherlands, and fasteners held together by a plurality of flanged or "mushroom"-shaped elements, such as 3M DUAL LOCK fasteners manufactured by 3M Company of Saint Paul, Minn. Press-fastener may also include adhesives, including reusable gel adhesives, GECKSKIN adhesives developed by the University of Massachusetts in Amherst, of Amherst, Mass., or other reusable adhesives. Where press-fastener includes an adhesive, the adhesive may be entirely located on the first surface of the press-fastener or on the second surface of the press-fastener, allowing any surface that can adhere to the adhesive to serve as the corresponding surface. In some embodiments, fastener 104 is a press-fastener including a first surface 116 secured to the user; in other words, fastener 104 may attach object 108 to the user by pressing that first surface 116 against a second surface 120 secured to object 108. Press-fastener may be mounted on any flexible or rigid material or combination of materials, including without limitation metal, wood, carbon fiber, graphene, flexible or rigid polymer materials such as plastic or rubber, textile materials, leather, or fiber mats. In other embodiments fastener 104 includes a kind of fastener other than a press-fastener, including without limitation a buckle, a slide fastener, one or more snaps, one or more buttons, or one or more clasps. Fastener 104 may include an attachment device that has a quick-release mechanism, defined as a mechanism having a member which, when pulled, cause the attachment device to detach rapidly. As a non-limiting example, the fastener 104 may include a quick-release buckle such as the SNAPDRAGON quick-release buckles produced by Illinois Tool Works of Glenview, Ill. Persons skilled in the art, upon reading this description, will be aware of various devices having quick-release mechanisms that may be used for fastener 104.

Fastener 104 may be secured to a user. Fastener 104 may be secured to the user in any suitable manner. In some embodiments, fastener 104 is secured to the user by at least a shoulder strap 124. At least a shoulder strap 124 may include a sash-style single strap, such as the strap of a courier bag. At least a shoulder strap 124 may include two shoulder straps, such as shoulder straps typically used with a backpack. At least a shoulder strap 124 may be constructed of any suitable material or combination of materials, including without limitation artificial or natural textiles, artificial or natural polymer material, leather, or other flexible sheets or straps; at least a shoulder strap 124 may be composed in part of webbing, such as flat webbing. At least a shoulder strap 124 may include padding, which may be made of any suitable material, including without limitation fiber matting, open or closed-cell foam made with natural or artificial polymer materials, or one or more layers of flexible material. Fastener 104 may be secured to the user by a garment 128. In some embodiments, garment 128 is a vest. As a non-limiting example, vest may be a tactical vest, such as a bulletproof vest, shrapnel-proof vest, or other vest incorporating body armor. Garment 128 may include another item of clothing such as a jacket or a shirt. In other embodiments, fastener 104 is secured to the user by another item 132 such as a belt, a back brace, or a chest strap. Fastener 104 may be attached to a combination of the above-described items; for example, fastener 104 may be secured to a user by a vest with shoulder straps, or a combination of shoulder straps, a back brace, and a belt. Persons skilled in the art will be aware of many possible combinations of elements that may be used to secure fastener 104 to the user, including a side variety of tactical garments, body-armor garments, and load-bearing garments.

It is noted that while fastener 104 is described above as secured to a user, in some embodiments, fastener may be secured to another object such as an animal, a vehicle, the interior or exterior of a building, or any permanent or movable structure. In some embodiments, by way of example, quick-release attachment mechanism 100 is utilized in a storage assembly in which fastener 104 is attached to a structure. Structure may include any object that supports the weight of object 108, including without limitation a building, a wall, a pole, a post, a temporary shelter such as a tent, a vehicle, or a trailer.

Fastener 104 may be attached to the element securing the fastener 104 to the user by any suitable means. For instance, fastener 104 may be sewn to one or more straps, such as straps of webbing. Fastener 104 may be sewn to one or more panels of textile material. Fastener 104 may be attached to a rigid element such as a frame or a rigid portion of a vest; fastener 104 may be attached to the rigid portion using bolts, screws, rivets, snaps, straps, or any other suitable means. Fastener 104 may be tied to an item worn by the user. Fastener 104 may be buckled to an item worn by the user. Fastener 108 may be attached to one or more support elements of a load-bearing garment such as a tactical vest; a tactical vest may have elements including but not limited to straps, such as webbing straps, plates, sheets of flexible material, belts, or rigid frame elements designed to distribute weight of armor and equipment across the tactical vest, to prevent undue strain on a user's back or other body parts, to which fastener 104 may be secured, as further explored in exemplary embodiments discussed below.

Pull-handle 112 is attached to fastener 104. In some embodiments, pull-handle 104 is attached directly to fastener 104; for instance, pull-handle 112 may be sewn to fastener 104, or attached with a loop of webbing. Where fastener 104 includes a quick-release buckle or other attachment device with a quick-release mechanism, fastener 104 may be attached to the quick-release mechanism. In other embodiments, pull-handle 112 is attached to fastener 104 indirectly. For instance, pull-handle 112 may be attached to object 108, and thus indirectly to fastener 104. Pull-handle 112 may be attached to fastener 104 by a flexible member 136. Flexible member 136 may have a first end attached to fastener 104 and a second end attached to pull-handle 112. First end may be attached to fastener 104 in any way that pull-handle 112 may be attached to fastener 104, including without limitation direct attachment, attachment to a quick-release mechanism, and attachment to object 108. Flexible member 136 may be composed of any suitable material or combination of materials; as a non-limiting example, flexible member 136 may include a length of webbing. Flexible member 136 may be sufficiently long to place pull-handle 112 in a location that is easily accessible for the user; for instance, where fastener 104 is located on a difficult part of the user to access, such as the user's back, flexible member 136 may hang down from that location so that pull-handle 112 may be located in the vicinity of the user's waist. Pull-handle 112 may also be attached near a bottom of object 108, where the bottom of the object 108 is the portion of the object 108 closest to a surface on which the user is standing when fastener 104 is engaged.

Pull-handle 112 acts to disengage fastener 104 when pulled by the user. Where fastener 104 is a device with a quick-release mechanism, such as a quick-release buckle, pull-handle 112 may act to disengage fastener 104 by causing the quick-release mechanism to release, detaching fastener 104. Where fastener 104 is a press-fastener, pull-handle may disengage fastener 104 by pulling one edge of second surface 120 of fastener 104 away from first surface 116; this may cause tension on pull-handle 112 when pulled by the user to disengage a small part of the surfaces of fastener 104 at a time, requiring far less force to disengage fastener 104 than would be required to pull apart the entirety of first surface 116 and second surface 120 simultaneously. In some embodiments, pull-handle 112 is attached to an edge of fastener 104. In other words, pull-handle 112 may be attached to an edge of first surface 116 or second surface 120, so that pulling on the pull-handle 112 peels the surface to which the pull-handle 112 is attached away from the surface to which the pull-handle 112 is not attached. Pull-handle 112 may be attached to a top edge of press-fastener, where top edge is the edge closest to the top of the head of the user, when object 108 is attached to the user using press fastener. Pull-handle 112 may be attached to a bottom edge of press-fastener, where the bottom edge is the edge farthest to the top of the head of the user, when object 108 is attached to the user using press fastener. Pull-handle 112 may be attached to another edge of press-fastener, such as a side edge.

Pull-handle 112 may be attached directly to edge; for instance, pull-handle 112 may be sewn to edge, or attached with a loop of webbing. In other embodiments, pull-handle 112 is attached to edge indirectly. For instance, pull-handle 112 may be attached to a portion of object 108 that is near to the edge; as a non-limiting example, where edge is top edge of press-fastener, pull-handle 112 may be attached to top edge to a top of object 108; top of object 108, as used herein, is a portion of the object 108 closest to the top of the head of the user, when the object 108 is attached to the user using the fastener. Pull-handle 112 may be attached to edge, or to object 108 near edge, using flexible member 136; for instance, first end of flexible member 136 may be attached to edge of press-fastener, or to a portion of object 108 near to edge. As a non-limiting illustration, first end of flexible member 136 may be attached to or near top edge, and flexible member 136 may hang down so that second end is near bottom of object 108, where bottom is the portion of object farthest from the top of the user's head when fastener 104 is fastened; as a result, a user may be able to reach pull-handle 112 at a lower point on the user's body, such as the waist-level, making it easier to grasp and pull pull-handle, disengaging press-fastener beginning at top edge. In some embodiments, attaching pull-handle 112 at or near top edge allows gravity to assist in detaching press-fastener. Persons skilled in the art will be aware, upon reading the entirety of this disclosure, that press-fastener may also be dislodge using flexible member 136 attaching pull-handle to another edge, such as a side edge.

In some exemplary embodiments, quick-release attachment mechanism includes least a flexible connector 140 that attaches object 108 to the user when fastener 108 is disengaged. At least a flexible connector 140 may be constructed of any suitable material or combination of materials, including but not limited to any materials suitable for the construction of at least a shoulder strap 124, any materials suitable for the construction of flexible member 136, or webbing such as flat webbing. At least a flexible connector 140 may be constructed of flexible material; for example, flexible connector 140 may include a length of webbing. At least a flexible connector 140 may include one or more substantially rigid elements; each of the one or more substantially rigid elements may be joined to the rest of flexible connector by a joint or a piece of flexible material. As a non-limiting example, a rigid element may have a rectangular buckle portion or tri-glide which may be attached to webbing, allowing the rigid element to be connected to webbing, and thus ensuring that at least a flexible connector 140 as a whole is flexible.

In some embodiments, at least a flexible connector 140 allows object 108 to move from a first position in which fastener 104 is engaged to a second position in which fastener 104 cannot engage; second position is one in which fastener 104 cannot engage if object must be moved back to the first position to engage fastener 104. For example, where fastener 104 is a press fastener, second position is a position in which first surface 116 and second surface 120 have essentially no overlap, so that press fastener cannot couple first surface 116 and second surface 120 sufficiently to resist the weight of object 108 or the forces attendant to the user moving about with object 108 attached. As a non-limiting example, first position may be on the back of the user, and second position may be lower than the back of the user. In some embodiments, at least a flexible connector 140 has a first end 144 attached to bottom of first surface 116 and a second end 148 attached to top of object 108; likewise, second end 148 may be attached to top of second surface 120. In some embodiments, flexible connector 140 includes first end 144 attached at or near bottom of fastener 104 and second end 148 attached at or near top of object 108. This arrangement may allow object 108 to fall from first position to second position while maintaining substantially the same orientation; for instance, where object 108 includes a compartment having an opening near the top of the compartment when fastener 104 is attached, the opening may remain near the top of the compartment when fastener 104 is detached and object 108 falls to second position. As a further example, first end 144 may be secured to the back of user, for instance by attachment to a strap, belt, garment or other element to which fastener 140 may be mounted.

In some embodiments, fastener 104 is a first fastener and at least a flexible connector 140 includes at least a second fastener 152 linking object 108 to user. As used herein, at least a second fastener 152 links object 108 to user if each fastener of at least a second fastener 152 connects a first part of a flexible connector of at least a flexible connector 140 to a second part of flexible connector, so that unfastening the second fastener 152 detaches the first part of flexible connector 140 from the second part of flexible connector 140. Thus, if each of at least one second fastener 152 is unfastened while fastener 104 is unfastened, object 108 may detach completely from user. First part may include only a portion of at least a second fastener 152; in other words, at least a second fastener 152 may be attached directly to object 108 or to fastener 104, at least a strap 124, or garment 128. Alternatively, first part may include an additional portion of at least a flexible connector 140. Similarly, second part may include only a portion of at least a second fastener 152 or may include an additional portion of at least a flexible connector 140. At least a second fastener 152 may be at either end of at least a flexible connector 140, or somewhere in between the ends of at least a second connector 140.

At least a second fastener 152 may include any suitable fastener, including without limitation a press fastener, a buckle, one or more snaps, a slide fastener, or a clasp. In some embodiments, at least a second fastener 152 includes a fastener with a quick-release mechanism 156; fastener with a quick-release mechanism may be any device with a quick-release mechanism as described above, including without limitation a buckle with a quick-release mechanism. Quick-release mechanism may be attached to a manual actuator 160. Manual actuator 160 may include a flexible portion, which may be constructed using any material or combination of materials suitable for the construction of flexible member 136, such as a strap or cord. In some embodiments, pulling on manual actuator 160 causes quick release mechanism 156 to release, unfastening at least one second fastener 152.

In an exemplary embodiment, at least a flexible connector 140 is secured to user by attachment to a strip of webbing with loops 164. Strip of webbing with loops 164 may be formed by sewing a strip of webbing to a fabric panel attached to or incorporated in at least a shoulder strap 124, garment 128, or other element 132 securing fastener 104 to the user. Strips of webbing with loops 164 may be formed by sewing webbing to fabric panel at regular intervals, between which webbing is not fixed to fabric panel, and forms loops, for instance as described in further detail below for at least a strip of webbing with loops 412 in connection with FIG. 4. A portion of at least a flexible connector 140 may be inserted through a loop in strip of webbing with loops 164. As a non-limiting example, webbing at the end of at least a flexible connector 140 may be inserted through a loop, doubled over the loop, and then sewn down; in some embodiments, the loop is also sewn to fabric panel.

Figure 2:
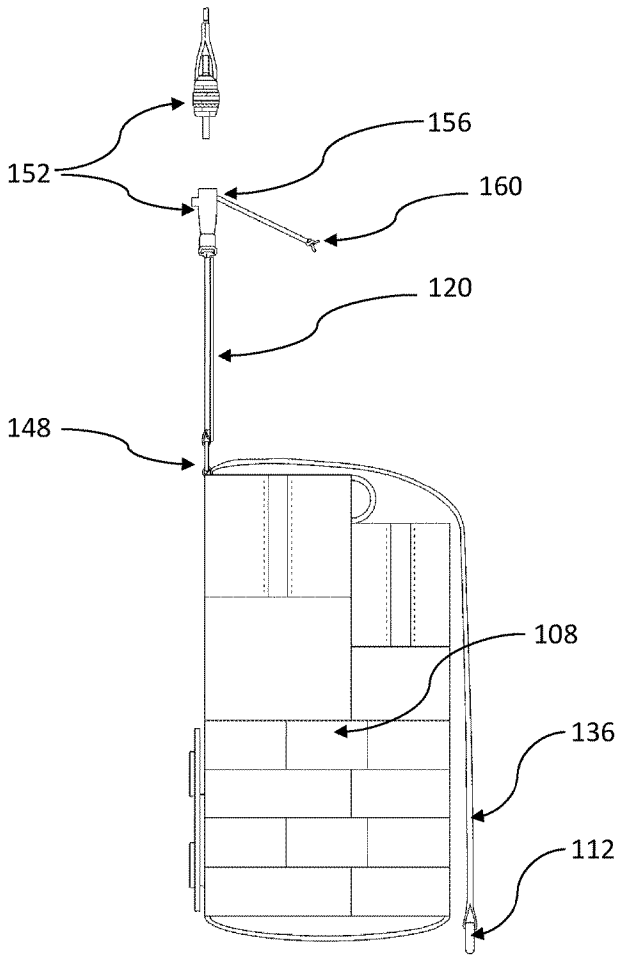
FIG. 2 is an illustration of a portion of an exemplary quick-release attachment mechanism with a disengaged second fastener accordance with aspects of an embodiment.

FIG. 2 illustrates an exemplary embodiment of a portion of quick-release attachment mechanism in which at least a second fastener 152 is detached. At least a second fastener 152 is depicted as a quick-release buckle for illustrative purposes only; persons skilled in the art, upon reading the entirety of the disclosure, will be aware that at least a second fastener 152 may include any of a large variety of different mechanisms, as noted above. In some embodiments, at least a second fastener 152 may be detached when fastener 104 is detached; for instance, at least a second fastener 152 may be detached when object 108 is in second position as described above in reference to FIGS. 1A-1C. In other embodiments, at least a second fastener 152 may be detached when first fastener 104 is attached, for instance when object 108 is in first position. It may be possible to detach at least a second fastener 152 whether first fastener 104 is detached or not.

Figure 3:
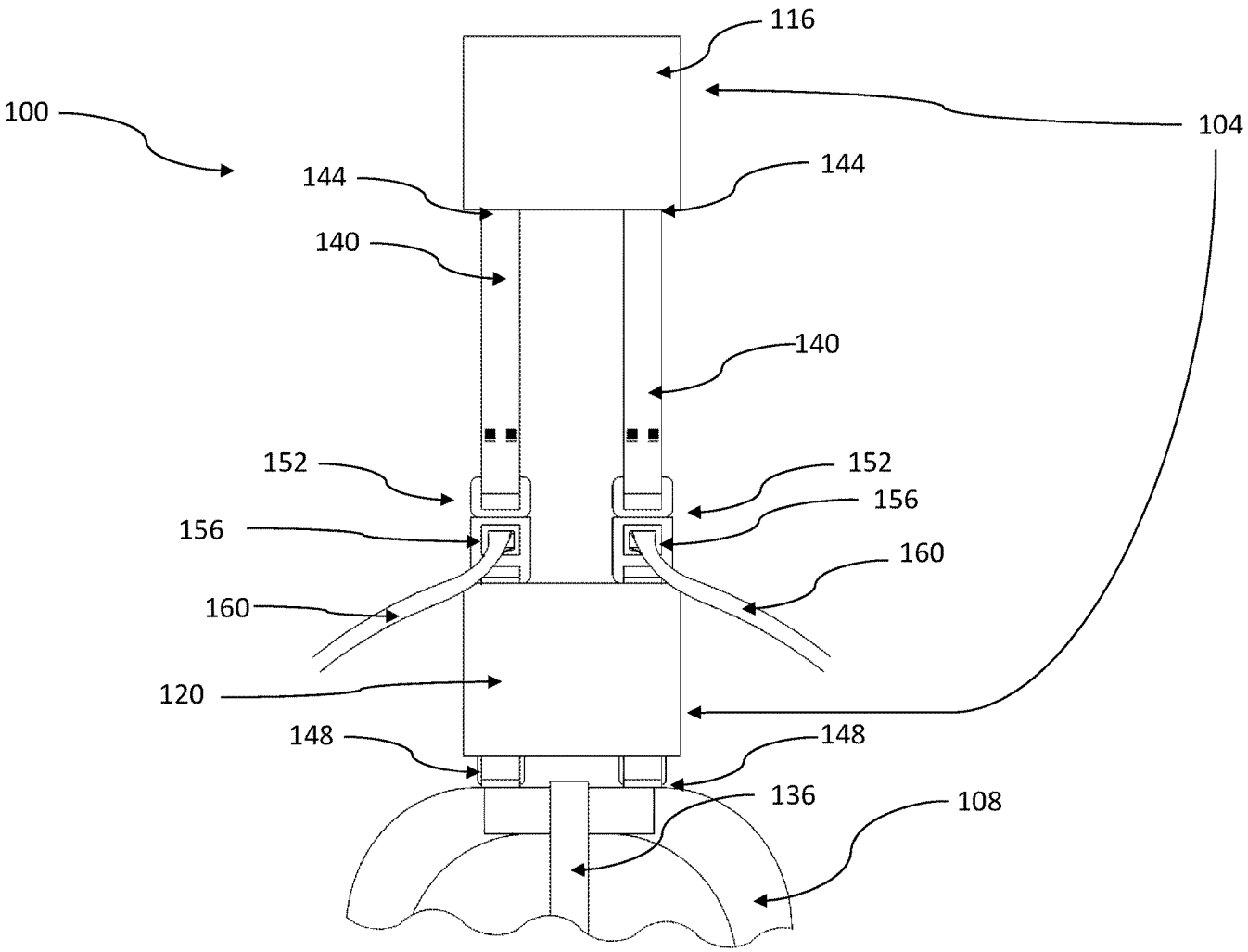
FIG. 3 is an illustration of an exemplary quick-release attachment mechanism in accordance with aspects of an embodiment.

In some embodiments, fastener 104 is attached to at least a flexible connector 140. For example, where fastener 104 is a press fastener having a first surface 116 secured to the user and a second surface 120, second surface 120 may be secured to at least a flexible connector 140. FIG. 3 illustrates an exemplary embodiment of quick-release attachment mechanism 100 with at least a flexible connector 140. Second surface 120 may be mounted to at least a flexible connector 140 in any manner for attaching fastener 104 to the element securing the fastener 104 to the user. For example, where at least a flexible connector 140 includes webbing, second surface 120 may be attached to the webbing; second surface 120 may be sewn to the webbing, or attached using any other suitable technique.

As illustrated for exemplary purposes only in FIG. 3, at least a flexible connector 140 may include two flexible connectors; two flexible connectors may be equidistant from a vertical axis of object 108. Each flexible connector may have a second fastener 152 linking object 108 to user. Each second fastener 152 may include a quick release mechanism 156 with an actuator 160; each actuator may be elongated so user is able to grasp actuator 160 easily when quick-release attachment mechanism 100 is secured to the back of the user. In some embodiments, each actuator includes a length of cord, so that user may unfasten first fastener 140 by pulling on pull handle and unfasten second fasteners 152 by pulling on actuators 160. Thus, for example, user may be able rapidly to remove object 108 altogether, or to swing object 108 to second position where object 108 may be accessed more easily. As a non-limiting example, each flexible connector may be approximately 10 inches long. The foregoing example is described for illustrative purposes only; persons skilled in the art, upon reading the entirety of the disclosure, will be aware of many other ways to implement quick-release attachment mechanism 100.

It is reiterated that in some embodiments fastener 104 is not necessarily a press-fastener, and may be any fastener that is capable of being disengaged using pull handle 112, including without limitation a press-fastener, a quick-release buckle, or any other fastener with a quick release mechanism. For instance, viewing FIGS. 1A-3, in an exemplary embodiment of quick-release attachment mechanism 100, fastener 104 is a first a first fastener secured to a user, the first fastener attaching an object 108 to the user. In the exemplary embodiment, quick-release attachment mechanism 100 includes a pull handle 112 attached to object 108, pull handle 112 acting to disengage first fastener when pulled by the user. In the exemplary embodiment, quick-release attachment mechanism 100 includes at least a flexible connector 140 attaching object 108 to user. In the exemplary embodiment, flexible connector 140 includes at least a second fastener 152 linking object 108 to the user.

Further exploring the exemplary embodiment, first fastener may be any fastener 104 described above in reference to claims 1A-3, including without limitation press fasteners, quick release buckles, and other fasteners with quick release mechanisms. Similarly, at least a flexible connector 140 may be any at least a flexible connector described above in connection with FIGS. 1A-3. At least a second fastener 152 may include any at least a second fastener 152 described above in connection with claims 1A-3; in some embodiments, at least a second fastener 152 includes a quick-release mechanism. For instance, quick-release attachment mechanism 100 may include at least a manual actuator 160, the at least a manual actuator 160 acting to disengage the at least a second fastener when the at least a manual actuator 160 is pulled by the user. At least a manual actuator 160 may be any manual actuator 160 described above in connection with FIGS. 1A-3. Persons skilled in the art, upon reading this disclosure, will be aware of many alternative ways in which the elements of quick-release attachment mechanism 100 may be combined as described above; all such combinations are contemplated as within the scope of this disclosure.

Figure 4:
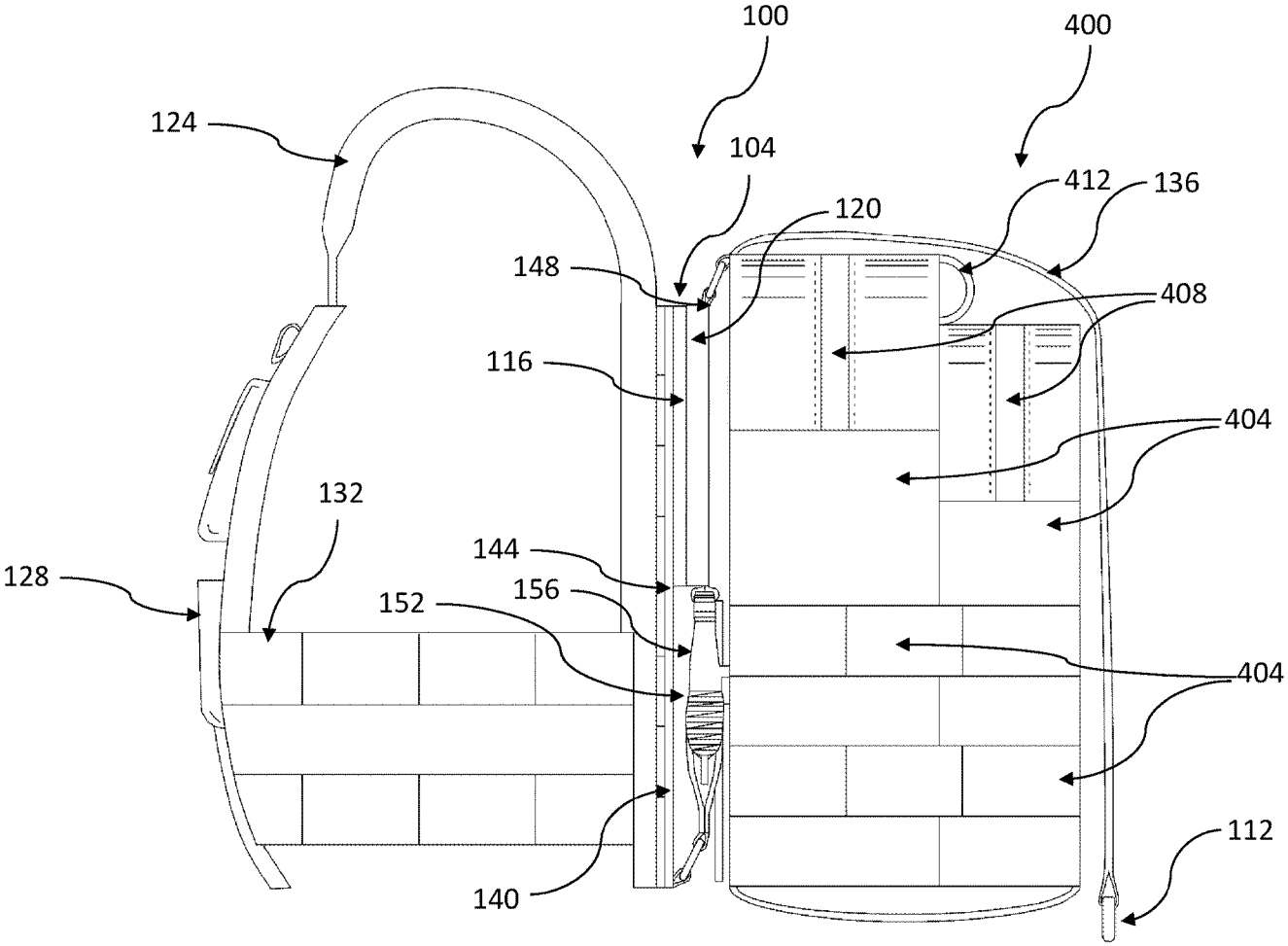
FIG. 4 is an illustration of an exemplary portable container with a quick-release attachment mechanism in accordance with aspects of an embodiment.

Turning now to FIG. 4, an exemplary embodiment of a portable container 400 with a quick-release attachment mechanism is illustrated. Portable container 400 includes at least a compartment 404. Portable container 400 includes a quick-release attachment mechanism 100.

Viewing FIG. 4 in further detail, portable container 400 includes at least a compartment 404. At least a compartment 404 may be any object with an interior space in which items may be carried. At least a compartment 404 may include a pouch, a bag, a box, or a compartment such as a compartment of a backpack. At least a compartment 404 may be constructed of any suitable materials or combination of materials including without limitation textile material, flexible or rigid polymer materials such as plastic or rubber, leather, metal, wood, or composite materials. At least a compartment 404 may be composed of any materials suitable for the construction of at least a shoulder strap 124, garment 128, or other item securing fastener 104 to user 132, as described above in connection with FIGS. 1A-3. At least a compartment 404 may include any number of compartments; for instance, at least a compartment 404 may include a larger first compartment and a smaller second compartment. At least a compartment 404 may include additional pockets, pouches, and other storage elements, as persons skilled in the art will be aware.

At least a compartment 404 may include an opening 408 through which the contents of at least a compartment 404 may be accessed. Opening 408 may be closeable; for instance, opening 408 may include a fastener that fully or partially closes opening 408. Fastener may include a slide fastener, such as a zipper. Opening 408 may be closed with a fold-over flap (not shown), which may be a flap of fabric or other flexible material that folds over the opening 408; fold-over flap may be secured by any suitable means including buckles or press fasteners as described above.

At least a compartment 404 may include one or more straps 412 for attaching items to portable container 400; for instance, at least a compartment 404 may include a loop for inserting an item such as a flashlight or glow stick. At least a compartment 404 may include at least a webbing strip with loops 416. At least a webbing strip with loops 416 may be made using one or more fabric webbing strips attached horizontally on a surface of compartment 404; where there are two or more webbing strips with loops 416, the webbing strips may be parallel to each other. Webbing loops on at least a webbing strip with loops 416 may achieved by stitching vertical lines down the horizontal strips at intervals, so that loops may be formed by the unsecured sections of webbing between stitching; it is noted that the loops may be similarly achieved using other attachment means such as stapling, adhesion, or heat-bonding, of which persons skilled in the art will be aware. Stitching may be evenly spaced; as a non-limiting example, vertical lines may be stitched in the webbing approximately every 1.5 inches. End edges of the webbing may also be stitched to at least a compartment 404. In some embodiments, additional items may be attached to loops, including without limitation additional compartments, items with belt clips, and the like. At least a compartment 404 may include one or more surfaces of press-fasteners (not shown) on an exterior surface of at least a compartment 404, such as one or more panels of a hook-and-loop fastener; users may attach identifying badges or other items to the one or more surfaces of press-fasteners.

At least a portable container includes a quick-release attachment mechanism 100. Quick-release attachment mechanism 100 may be any quick-release attachment mechanism 100 as described above in connection with FIGS. 1A-3. For instance, quick-release attachment mechanism may include a fastener 104, which may be a press-fastener, secured to a user, the fastener 104 attaching the at least a compartment 404 to the user. Where fastener 104 is a press-fastener, fastener 104 may include a first surface 116 secured to the user and a second surface 120 secured to the portable container. Quick-release attachment mechanism 100 may include a pull handle 112 attached to at least a compartment 404, the pull handle acting to disengage fastener 104 when pulled by the user. Pull-handle may be attached to fastener 104 by a flexible member 136 as disclosed above. Fastener 104 may be secured to the user; in some embodiments, fastener 104 is secured to the back of the user. Fastener 104 may be secured to user by at least a shoulder strap 124, a garment 128, which may include a vest or tactical vest, or an additional item 132, as described above in reference to FIGS. 1A-3.

Quick-release attachment mechanism 100 may include at least a flexible connector 140 as described above; at least a flexible connector may include a first end 144 secured to user and a second end 148 secured to at least a compartment 404. As a non-limiting example, second end may be secured to at least a compartment 404 by inserting a flexible portion at second end 148, such as a strip of webbing, through one of loops in at least a webbing strip with loops 416. Second end 148 may be looped through loop of at least a webbing strip with loops 416. Second end 148 may be stitched to loop; for instance, second end 148 may be looped through loop and then stitched to loop. Second end 148 and/or loop may be stitched or otherwise attached to an exterior surface of at least a compartment 404. Quick-release attachment mechanism 100 may include at least a second fastener 152 linking portable container 404 to user, which may be any second fastener 152 as described above; at least a second fastener may include a quick release mechanism 156.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A quick-release attachment mechanism, the quick-release attachment mechanism comprising:

a flexible connector having a first end secured to a user and a second end secured to an object;

a press-fastener having a first surface secured to the user by at least one shoulder strap, and a second surface attached to the flexible connector between the first end and the second end; and a pull handle attached to the press-fastener, the pull handle acting to disengage the press-fastener when pulled by the user;

wherein the quick-release attachment mechanism is movable between a first position in which the second surface of the press-fastener is attached to the first surface of the press-fastener and the flexible connector is folded between the object and the user, and a second position in which the second surface of the press-fastener is detached from the first surface of the press-fastener, and the flexible connector is extended, whereby the object is moved from a first position a first distance the first surface to a second position a second distance from the first surface, the second distance greater than the first distance.

2. The quick-release attachment mechanism of claim 1, wherein the press-fastener is secured to the back of the user.

3. The quick-release attachment mechanism of claim 1, wherein the press-fastener is secured to the user by a garment.

4. The quick-release attachment mechanism of claim 3, wherein the garment further comprises a vest.

5. The quick-release attachment mechanism of claim 1, wherein the pull handle is attached to the press-fastener by a flexible member.

6. The quick-release attachment mechanism of claim 5, wherein the flexible member further comprises a length of webbing.

7. The quick-release attachment mechanism of claim 1, wherein the pull handle is located at a bottom of the object when the press-fastener is engaged.

8. The quick-release attachment mechanism of claim 1, wherein the pull handle is attached to an edge of the press-fastener.

9. The quick-release attachment mechanism of claim 8, wherein the pull handle is attached to a top edge of the press-fastener.

10. The quick-release attachment mechanism of claim 1, wherein the at least a flexible connector allows the object to move from a first position in which the press fastener is engaged to a second position in which press-fastener cannot engage.

11. The quick-release attachment mechanism of claim 10, wherein the first position is on the back of the user and the second position is lower than the back of the user.

12. The quick-release attachment mechanism of claim 1, wherein the at least a flexible connector further comprises a first end attached to a bottom of the first surface and a second end attached to a top of the object.

13. The quick-release attachment mechanism of claim 1, wherein the at least a flexible connector further comprises a length of webbing.

14. The quick-release attachment mechanism of claim 1, wherein the press-fastener is a first fastener, and the at least a flexible connector further comprises at least a second fastener linking the object to the user.

15. A portable container with a quick-release attachment mechanism, the portable container comprising:

an object including at least a compartment;

a flexible connector having a first end secured to a user and a second end secured to the object;

a press-fastener having a first surface secured to the user by at least one shoulder strap and a second surface attached to the flexible connector between the first end and the second end; and a pull handle attached to the at least a compartment, the pull handle acting to disengage the press-fastener when pulled by the user;

wherein the quick-release attachment mechanism is movable between a first position in which the second surface of the press-fastener is attached to the first surface of the press-fastener and the flexible connector is folded between the at least a compartment and the user, and a second position in which the second surface of the press-fastener is detached from the first surface of the press-fastener, and the flexible connector is extended, whereby the at least a compartment is moved from a first position a first distance the first surface to a second position a second distance from the first surface, the second distance greater than the first distance.

16. A quick-release attachment mechanism, the quick-release attachment mechanism comprising:

a first fastener secured to a user by at least one shoulder strap, the first fastener further comprising a press fastener attaching an object to the user;

a pull handle attached to the first fastener, the pull handle acting to disengage the first fastener when pulled by the user;

at least a flexible connector attaching the object to user, the at least a first flexible connector including at least a first end secured to the user and at least a second end, wherein the flexible connector includes at least a second fastener located at the second end, the at least a second fastener connecting the second end to the flexible connector, whereby the object is detached from the flexible connector upon detachment of the second fastener.

17. The quick-release attachment mechanism of claim 16 further comprising at least a manual actuator, the at least a manual actuator acting to disengage the at least a second fastener when the at least a manual actuator is pulled by the user.

* * * * *